US006936294B2

(12) United States Patent
Matthews et al.

(10) Patent No.: US 6,936,294 B2
(45) Date of Patent: Aug. 30, 2005

(54) CORN DEGERMINATION PROCESS

(75) Inventors: Peter Matthews, Houston, TX (US); John Steinfort, Houston, TX (US); Alberto Macedo, Houston, TX (US)

(73) Assignee: Satake USA, Inc., Stafford, TX (US)

( * ) Notice: Subject to any disclaimer, the term of this patent is extended or adjusted under 35 U.S.C. 154(b) by 493 days.

(21) Appl. No.: 10/004,742

(22) Filed: Dec. 4, 2001

(65) Prior Publication Data

US 2003/0104101 A1 Jun. 5, 2003

(51) Int. Cl.[7] ..... B02B 5/02

(52) U.S. Cl. ..... 426/483; 426/507; 241/6; 241/7; 241/9

(58) Field of Search ..... 426/483, 507; 241/6, 7, 9

(56) References Cited

U.S. PATENT DOCUMENTS

| | | | | |
|---|---|---|---|---|
| 3,088,827 A | * | 5/1963 | Kaufman | 426/443 |
| 3,104,692 A | | 9/1963 | Davis et al. | |
| 4,066,012 A | | 1/1978 | Satake et al. | |
| 4,181,748 A | | 1/1980 | Chwalek et al. | |
| 4,301,183 A | | 11/1981 | Giguere | |
| 4,522,837 A | * | 6/1985 | Meinardus | 426/482 |
| 5,073,201 A | | 12/1991 | Giesfeldt et al. | |
| 5,250,313 A | | 10/1993 | Giguere | |
| 5,678,477 A | | 10/1997 | Satake et al. | |
| 6,254,914 B1 | | 7/2001 | Singh et al. | |

OTHER PUBLICATIONS

Derwent Abstract. Acc No. 1981–01348D. Abstract for SU 733723 published May 1980.*

* cited by examiner

*Primary Examiner*—Anthony Weier
(74) *Attorney, Agent, or Firm*—Keeling Hudson LLC; Kenneth A. Keeling; James E. Hudson, III

(57) ABSTRACT

The present invention provides a process to remove the germ from the endosperm of a corn kernel. The apparatus of the present invention comprises frictional cylindrical rollers, each roller rotating about an axis, the axis of the rollers substantially parallel, and the direction of rotation being opposing. The roller bodies having a rubberized covering, rotate with differing surface velocities and are tensioned such as to impart low-impact friction forces to corn kernels drawn between the roller covers. The process of the present invention includes a tempering step comprising adding an amount of moisture to the corn by wetting and soaking the corn; a polishing step for removing bran layers from the corn; a second tempering step comprising adding an additional amount of moisture to the corn by wetting and soaking the corn; and a friction step to remove germ from the endosperm.

17 Claims, 2 Drawing Sheets

CORN DEGERMINATION PROCESS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to corn milling and more particularly to improved processes for degermination of corn.

2. Description of the Related Art

Corn milling processes separate corn into various components of the kernel. In a wet-milling process, the corn is steeped in an aqueous solution to soften the kernel and ground to free the germ. Aqueous processes are described in U.S. Pat. No. 5,073,201 to Gisfeldt et al. In a dry-milling process, the corn kernel is separated into the endosperm, germ and other fibers (referred to as a hull or bran layer) in a dry or slightly moistened condition.

One of the necessary steps in the dry corn milling process, whether the milled product is to be used for the production of methanol, starch, flakes, grits or flour, involves separation of the bran layer and the germ (also referred to as embryo) from the endosperm, which is then processed further to produce the milled corn product.

In a typical dry milling process, corn kernels are cleaned to remove extraneous material. The cleaned corn is tempered with water or steam then passed through a degerminating mill to release the hull from the germ and endosperm.

Traditionally, germ has been removed from corn kernels during milling through the use of a "Beall" type degerminator. In the Beall type of degerminator, corn is fed into and through the annulus formed between a rotating, conical rotor and a stationary concentric screen made of perforated metal. Both rotor and screen are textured with large nodes, which impede motion of the kernels as they turn with the rotor. A weighted discharge plate provides a method of controlling pressure and corn density within the chamber. In this process, the germ is dislodged from the endosperm by impact and bending stress as the kernels move through the annulus. In practice, most of the kernels are broken during the process. Typically, this process produces an effective recovery of endosperm particles of which approximately twenty to thirty percent of the endosperm pieces will be retained on a No. 6 standard sieve cloth. Because a significant portion of the bran layers may still adhere to the pieces of endosperm after the degermination process, further refinement of the endosperm may be required to reduce the fiber content of the endosperm product.

Inherent inefficiencies in refining and recovery processes result in increased processing costs and a reduction in the overall yield of low fat corn products.

For any of the milled corn products, the production of low fat products is desirable. In general, it is desirable during the degermination stage of the corn milling process to produce large particles of endosperm that are largely free of bran and germ. Though the degermination process can be destructive to the corn kernels, it is generally desirable to minimize the production of fine particles of endosperm, as the fine particles are difficult to separate from the bran and germ particles in order to recover them as a corn product. Maximizing the production of large particles of endosperm thus offers maximum yields of corn products and improves the quality of the products.

U.S. Pat. No. 5,250,313 to Giguere (a continuation-in-part of U.S. Pat. No. 4,189,503) describes a degerminating process wherein the corn kernels are crushed from the thin edges toward the center while avoiding crushing of the relatively flat side surfaces. The crushing force fractures the endosperm under and around the germ and squeezes the germ away from the endosperm. A machine for carrying out the degermination includes relatively rotating discs having corrugations in their facing surfaces in which the kernels are caught and crushed from the thin edges toward the center. An alternative degerminator machine includes a single rotating disc having curved guide vanes on its upper surface for guiding the kernels as they are propelled outwardly by centrifugal force.

U.S. Pat. No. 6,254,914 describes a wet-milling process for recovery of corn coarse fiber (pericarp) including the steps of: soaking corn in water to loosen the attachments of various corn components therein to each other, degerminating the soaked corn to strip the corn coarse fiber and the germ away from the endosperm, recovering the germ, and recovering the corn coarse fiber by flotation. The degerminating step of such process involves grinding the kernels in a degermination mill such as a Bauer mill so that the pericarp and germ are stripped away from the endosperm.

U.S. Pat. No. 4,181,748 to Chwalek, et al. describes a combined dry-wet milling process for refining corn comprising dry milling corn kernels to provide an endosperm fraction, a germ fraction, a fiber (hull) fraction and a cleanings fraction, wet milling the endosperm fraction including using two distinct steeping steps, one upstream and the other downstream of an impact milling step, to provide a mill starch slurry. The process further comprises removing fine fiber tailings from the mill starch slurry, separating the slurry into a starch-rich fraction and protein-rich fraction, concentrating the protein-rich fraction, directly combining the fiber (hull), cleanings, fine fiber tailings and protein-rich concentrate without removing corn oil therefrom, with the germ fraction to provide a wet animal feed product, and drying the feed product.

U.S. Pat. No. 4,301,183 to Giesfeldt et al. discloses a method and apparatus for degerminating a corn kernel by impelling the kernels along a guide vane into an impact surface including a horizontal disc having a plurality of guide vanes extending in a curvilinear path with each vane terminating in an end portion that is substantially parallel to a tangent to the disc. A plurality of impact surfaces are provided in the same horizontal plane as the disc with each surface being substantially linear and extending transversely of the path of travel of a kernel impelled by the disc.

The prior art processes result in a high percentage of fine particles of endosperm that are difficult to separate from the bran and germ particles in order to recover them as a corn product.

Cylindrical, rubberized rollers have been used to remove hulls from other grains, particularly rice. Rollers for removing hulls from grains are described in U.S. Pat. No. 3,104,692 to Davis et al. dated Sep. 24, 1963, U.S. Pat. No. 4,066,012 to Satake and U.S. Pat. No. 5,678,477 to Satake et al. Despite the use of such rollers for removing hulls from grains and the long-standing need to separate corn germ from endosperm with a minimum amount of fine endosperm particles, the use of rubberized rollers and the process of the present invention have not been previously practiced.

BRIEF SUMMARY OF THE INVENTION

Accordingly, it is an object of the present invention to provide a process for increasing the production of large particles of endosperm, and thus maximize yields of low-fat corn products and improve the value of the products.

The present invention provides a process to remove the bran from the corn kernel, and the germ from the endosperm of a corn kernel. The apparatus of the present invention comprises opposing cylindrical rollers, each roller rotating about an axis; the axis of the rollers substantially parallel. The roller bodies have rubberized coverings, rotate with differing surface velocities and are controlled so as to impart shearing friction forces to corn kernels drawn between the rollers. The process of the present invention includes a tempering step comprising adding an amount of moisture to the corn and soaking the corn to soften the bran; a polishing step for removing bran layers from the corn; a second tempering step comprising adding an amount of moisture to the corn and soaking the corn to expand the germ; and a friction step to remove germ from the endosperm.

DETAILED DESCRIPTION OF THE INVENTION

Figure 1:
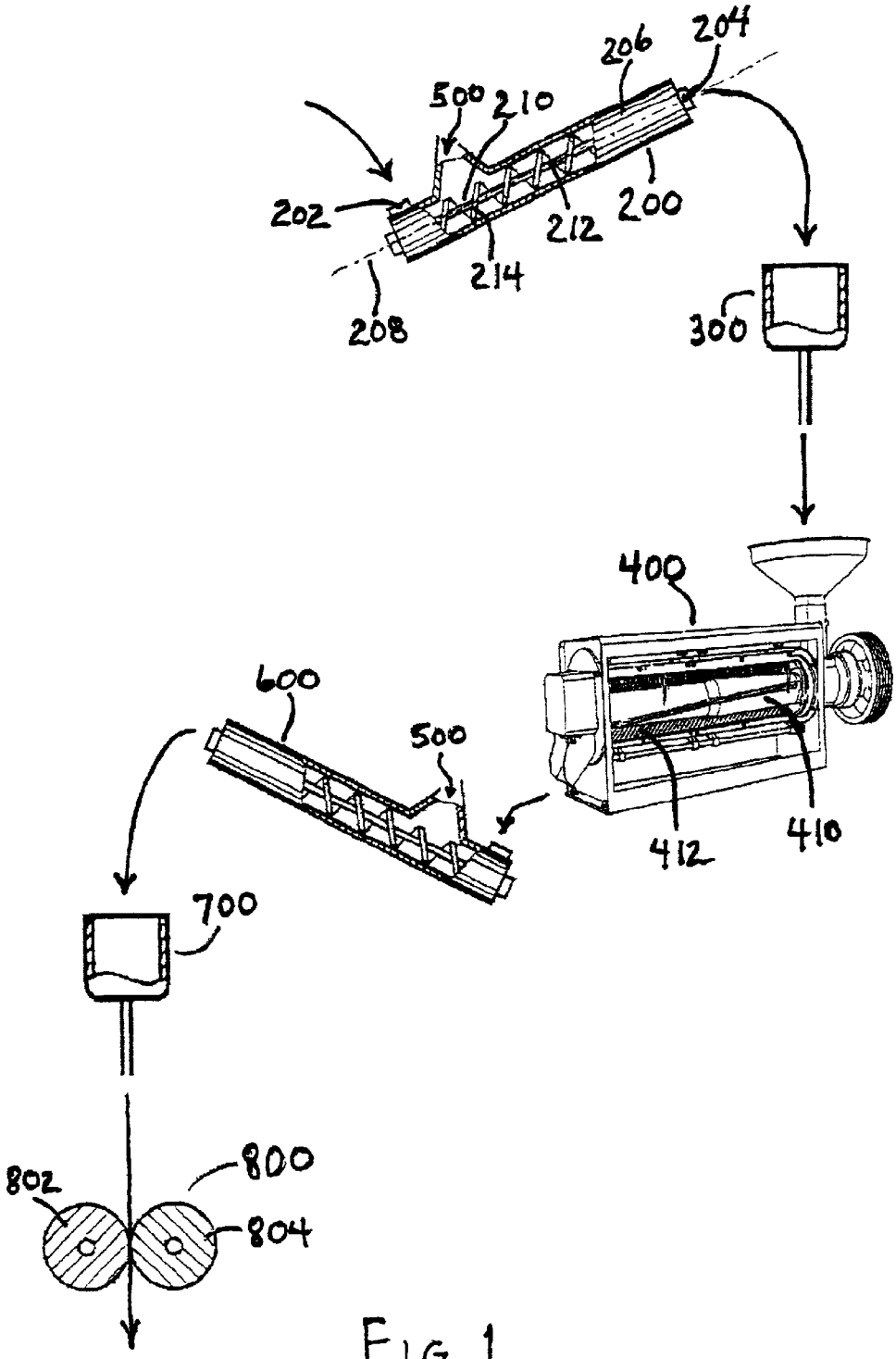
FIG. 1 depicts a schematic diagram of a degermination process incorporating the process of the present invention.
Figure 2:
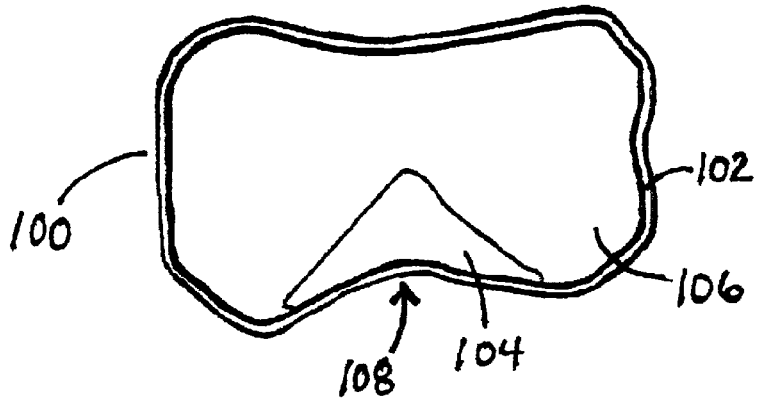
FIG. 2 depicts a cross-sectional top view of a corn kernel with the bran in place.
Figure 3:
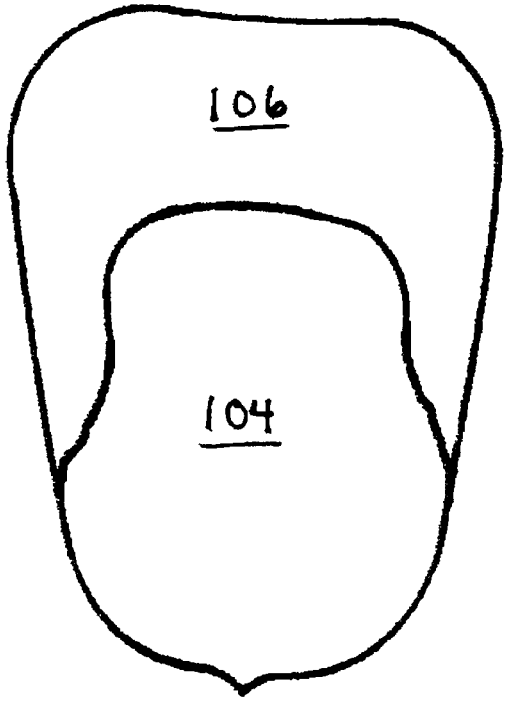
FIG. 3 depicts a front view of a corn kernel with the bran removed.
Figure 4:
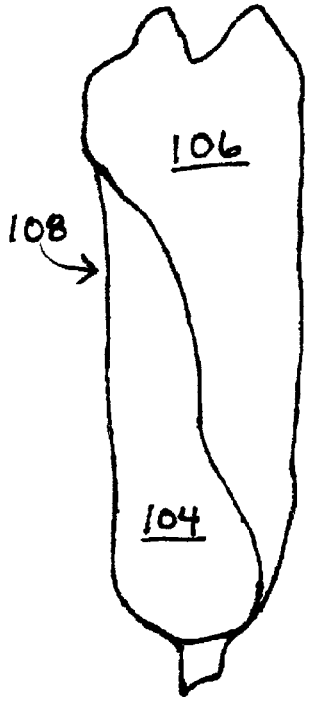
FIG. 4 depicts a side view of a corn kernel with the bran removed.

Referring first to FIGS. 1, 2 and 3, a corn kernel 100 is depicted for reference as to terms used herein. A typical corn kernel 100 includes a germ 104 and an endosperm 106 that are totally covered in a casing of bran 102. The germ 104 is embedded in one of the large, relatively flat sides 108 of kernel 100.

Referring to FIG. 1, the process of the present invention is depicted as a process flow diagram.

In the process of the present invention a measured amount of raw, clean corn kernels are first introduced into a first tempering mixer 200 where a measured amount of water 500 is added. The water 500 may be in various forms including water, steam or an aqueous solution. The first tempering mixer 200 comprises a generally cylindrical housing 206 having a central axis 208 and a co-axial auger 210. The auger 210 comprises a rotating shaft 212 having angled paddles 214, the angled paddles 214 transmitting the corn kernels (not shown) from a first inlet end 202 of the first tempering mixer 200 to a second outlet end 204 of the first tempering mixer 200. The rotating auger 210 distributes the water 500 on the corn kernels for complete wetting of the corn kernels to provide for even penetration of moisture.

Tempering mixers 200 are commonly used in the industry to provide uniform wetting of corn kernels. A suitable, commercially available tempering mixer is manufactured and sold by the Satake Corporaion and identified as a Technovator, model STMA.

The corn kernels are then transferred to a holding tank 300 where they are retained until the kernels obtain a desired level of moisture absorption, a process referred to as tempering. Tempering softens and expands the bran 102 layers, but does not last so long as to provide significant penetration of water 500 in the germ 104 or endosperm 106. Such moisturization makes the bran 102 more pliable, and weakens the bond between the wetted bran 102 and the less-absorbent germ 104 and endosperm 106, allowing the bran to be removed without disturbing the germ 104 or the endosperm 106.

Holding time in the holding tank 300 is typically three (3) to fifteen (15) minutes, depending on the variety of corn and the desired level of moisturization. In an exemplary embodiment the corn kernels are handled in a first-in, first-out basis and adding about 5% water by weight is sufficient moisturization. The invention allows for a varied range of moisture levels as needed in the resulting products for optimizing intended further processing.

The corn kernels are next introduced into a polishing machine 400, which consists of a rotating eccentric rotor 410 surrounded by a polygonal perforated metal screen 412. As the clearance between the screen 412 and the rotor 410 changes during each rotation, the corn kernels experience alternating cycles of compression and relaxation, producing an effective rubbing action. The polishing machine 400 ruptures the softened bran 102, which softened bran 102 leaves the milling chamber through the perforations in the screen 412.

A quantity of bran 102 remains attached to the corn kernel 100 after the polishing step. The remaining bran 102 is usually attached to the pointed end of the germ 104. The amount of bran 102 left on the germ 104 can be controlled and may be varied in relation to the desired end product from the processing. A controlled amount of bran still attached to the germ 104 is desired to assist in frictional removal of the germ 104 from the endosperm 106, and to increase the moisture content of the finished product (germ 104, with a small percentage of bran 102). The processor can use the amount of bran 102 left on the germ 104 to control the process and the finished product.

Polishing machines come in various configurations. A suitable, commercially practiced polishing machine 400 is manufactured by Satake USA and identified as a Mist Polisher. The typical polishing machine segregates the bran 102 from the remaining parts of kernel 100. If a polishing machine is configured not to segregate the separated components, an independent separation procedure may be accomplished subsequently in the process.

The bran 102 consists of a number of layers (individual layers not shown). The layers have differing properties and the potential for differing uses. The different layers of the bran 102 also absorb moisture at different rates. The present process allows for bran 102 removal to be done selectively by layer through one or more iterations of the tempering mixer 200, the holding tank 300 and the polishing machine 400.

Once the bran 102 is removed from the corn kernel 100, a controlled amount of moisture is again added to the corn kernels with a second tempering mixer 600, as previously done in the first tempering mixer 200. The corn kernels are then transported to a second holding tank 700 and tempered. During this period, moisture swells the germ 104, which absorbs the moisture more quickly that the endosperm 106, and loosens the bond between the germ 104 and the endosperm 106. The holding time may vary depending on the amount of moisture absorption required, but should not be long enough to break down the inter-cellular bonds of the starch of the endosperm 106, as such break down promotes breakage of the endosperm 106.

The corn kernels are then fed between two cylindrical rollers 802 and 804 that are covered with rubber, polyurethane or other material having suitable elastic properties. The two rollers 802 and 804 rotate at differing surface speeds in different directions, so the adjacent surfaces move the same direction. Because friction mandates that an object in contact with either roller 802 or 804 will attempt to move at the same linear speed as the surface of the roller, a shear force develops across the kernel 100, from the difference in linear speed applied to the two different sides of the kernel 100. This action causes the germ 104 to break away from the endosperm 106. The material covering the rollers must be sufficiently elastic to engage the corn kernels 100 gently enough to avoid cracking or crushing the kernels 100, yet rigid enough to resist rapid wear of the material. A stiff rubber or relatively dense polyurethane has been determined to have characteristics consistent with such requirement.

At least one of the rollers 802 or 804 is adjustable in relationship to the other so that the friction applied between the roller surfaces may be adjusted to provide sufficient friction to various size corn kernels to tear the germ 104 from the endosperm 106, but to avoid pulverizing the kernel 100.

The adjustability of inter-roller friction may be accomplished by varying the differential tangential velocity of the rollers, varying the gap between the rollers, tensioning the distance between the rollers with springs, pneumatic pistons or other tensioning device. Interactive assessment of the applied friction may be accomplished by monitoring the amperage drain of the roller motors, the air pressure in a pneumatic piston, the amperage of the air pressure production pump feeding the pneumatic piston, or other means.

In practice, the application of such friction will result in breaking away the germ 104 from the endosperm 106, and may also result in tearing of the endosperm 106, resulting in endosperm 106 particles. By minimizing the production of particles and by maximizing the size of particles produced, the highest value of the kernel may be realized. Endosperm 106 particles produced as a result of process of the present invention tend to be relatively large as such particles are produced as a result of a shear force rather than an impact force.

Germ 104 maintained in its whole state provides greater oil production. Endosperm 106 maintained in its whole segments or large particle state is suitable for high value end-product uses.

The resulting mixture of germ 104 and endosperm 106 may be separated by various methods. An exemplary method is to allow the mixture to fall through a rapidly moving column of air. The lighter germ 104 particles are lifted and separated from the heavier endosperm 106, and are collected and discharged separately.

A suitable, commercially practiced apparatus including cylindrical rollers and a rapidly moving column of air is a Rubber Roll Husker and Aspirator sold by Satake USA. Prior to the present invention such Rubber Roll Husker and Aspirator was used to remove rice hulls as described in U.S. Pat. No. 4,066,012 to Satake and U.S. Pat. No. 5,678,477 to Satake et al.

The process of this invention is further illustrated in the following example.

EXAMPLE

In the first step, water is added to a fixed quantity of whole corn kernels. The wetted corn kernels are allowed to rest for ten minutes prior to being introduced to a Mist Polisher (Model KB40G) at a controlled feed-rate of 6000 pounds per hour.

With a 2 mm×15 mm slotted screen installed in the polisher, two distinct stock separations—overtails and throughs—are generated. The overtails, referring to the product not allowed to pass through the 2 mm×15 mm screen, consist of whole corn kernels (endosperm and germ) and is relatively bran free. Overtails constitute 82.5% of the processed corn. The germ of the corn is still largely intact within the endosperm. The overtails pass to the second tempering stage. The throughs, referring to the product that passes through the 2 mm×15 mm screen, constitute 17.5% of the processed corn.

Analysis of the throughs shows that the 17.5% of the total corn stock consists of coarse bran, fine bran and pieces of endosperm grit. Sifting and aspiration would separate the majority of the endosperm grit from the bran, so that the recovered endosperm may go on to conventional purification and reduction, and ultimately become a useful end-product; however, further sifting and aspiration processes are not conducted in the present example.

After being separated in the polisher, the overtails are again tempered by wetting the corn kernels in a tempering mixer and then allowing them to rest in a holding tank. About 6% water by weight is added in about eight minutes of tempering. Next, the overtails are processed through rubber rollers. This is conducted using a Satake Laboratory Husker (Model THU 35). A tempered sample is fed into the rubber rollers and the roll friction adjusted to an optimum grind pressure for the particular corn batch.

In the Laboratory Husker a gap distance between the rollers is set so as to produce minimal breakage in the sample. The remaining overtails are then processed at that setting.

Analysis of the output from the rubber rollers indicate that the resulting product, as a percentage of total corn stock, is 7.10% large germ pieces, 2.66% large pieces of endosperm grit with adhering germ fragments, and 72.70% endosperm grit without adhering germ fragments. Passing the endosperm grit through a sifter having various sizes of mesh showed 58.66% of the total corn stock comprises endosperm grit that remains above a #6 Wire (3530 micron) mesh sifter.

The 7.10% large germ pieces consists of a high percentage of whole germs, which are ideal for efficient operation of further processing systems.

The 2.66% large pieces of endosperm grit with adhering germ may be retreated through the rubber roller friction process or diverted through an independent friction unit, depending on the capacity requirements of the user; however, such steps are not undertaken in the present example. Either step would result in separating additional clean endosperm grit from the germ fragments.

The foregoing disclosure and description of the invention is illustrative and explanatory thereof. Various changes in the details of the illustrated process may be made within the scope of the appended claims without departing from the spirit of the invention. The present invention should only be limited by the following claims and their legal equivalents.

What is claimed is:

1. A process for de-germinating corn kernels, comprising, in the sequence indicated:

a first tempering step;

a polishing step by effectively rubbing said bran to shear said bran from said endosperm;

a second tempering step; and a friction step wherein said friction step comprises applying friction forces to said corn kernels between at least two elastic surfaces.

2. The process as in claim 1 wherein:

each of said at least two elastic surfaces comprising rubber surfaces.

3. The process as in claim 1 wherein:

each of said at least two elastic surfaces comprising polyurethane surfaces.

4. The process as in claim 1 wherein:

said at least two elastic surfaces comprising surfaces of opposing rotating cylinders.

5. The process as in claim 4 wherein:

said opposing rotating cylinders operable at differing tangential velocities.

6. The process as in claim 4 wherein:

at least one of said opposing rotating cylinders adjustable in relation to the other said opposing rotating cylinder for adjustment of the friction forces applied to said corn kernels.

7. The process as in claim 1 wherein:

said first tempering step including wetting said corn kernels and soaking said corn kernels for a sufficient soaking period of time to allow penetration of wetting solution to soften and expand said corn kernel bran.

8. The process as in claim 7 wherein:

said first tempering step terminating prior to substantial penetration of wetting solution in said corn kernel endosperm or said corn kernel germ.

9. The process as in claim 7 wherein:

said soaking period of time lasting from three to fifteen minutes.

10. The process as in claim 1 wherein:

said polishing step comprising providing alternating cycles of compressive forces and relaxation of said corn kernels to remove said corn kernel bran from said corn kernels.

11. The process as in claim 1 wherein:

said second tempering step comprising wetting said corn kernels and soaking said corn kernels to soften and expand said corn kernel germ.

12. The process as in claim 11 wherein:

said second tempering terminating prior to absorption of sufficient wetting solution in said corn kernel endosperm to break down cellular bonds within a starch structure of said endosperm.

13. A process for de-germinating corn kernels comprising, in the sequence indicated:

a first tempering step including wetting said corn kernels and soaking said corn kernels to for a sufficient period of time to allow penetration of wetting solution to soften and expand the corn kernel bran without substantial penetration of wetting solution in the corn kernel endosperm or the corn kernel germ;

a polishing step for removing said bran from said corn kernels;

a second tempering step comprising wetting said corn kernels and soaking said corn kernels to soften and expand said germ without absorption of sufficient wetting solution in said endosperm to break down cellular bonds within a starch structure of said endosperm; and a friction step comprising applying friction forces to said corn kernels between at least two elastic surfaces.

14. The process as in claim 13 wherein:

said at least two elastic surfaces comprising surfaces of opposing rotating cylinders;

said opposing rotating cylinders operable at differing tangential velocities; and at least one of said opposing rotating cylinders adjustable in relation to the other said opposing rotating cylinder for adjustment of the friction forces applied to said corn kernels.

15. The process as in claim 13 wherein:

said first tempering step soaking period of time lasting from three to fifteen minutes.

16. The process as in claim 13 wherein:

said polishing step comprising providing alternating cycles of compressive forces and relaxation of said corn kernels to remove said bran of said corn kernels.

17. The process as in claim 13 wherein:

a separating step after said friction step for separating said germ from said corn kernels.

* * * * *